US006009670A

United States Patent [19]

Howard

[11] Patent Number: 6,009,670

[45] Date of Patent: Jan. 4, 2000

[54] GATE OPERATOR FOR VERTICAL GATE MOVEMENT

[76] Inventor: Glenn Howard, P.O. Box 911, Coarsegold, Calif. 93614

[21] Appl. No.: 09/241,225

[22] Filed: Feb. 1, 1999

[51] Int. Cl.[7] ..... E05F 11/24

[52] U.S. Cl. ..... 49/340; 49/226

[58] Field of Search ..... 49/226, 227, 232, 49/233, 234, 235, 333, 334, 338, 340

[56] References Cited

U.S. PATENT DOCUMENTS

| | | | |
|---|---|---|---|
| 4,519,164 | 5/1985 | Porter | 49/340 X |
| 4,658,543 | 4/1987 | Carr | 49/340 X |
| 4,887,393 | 12/1989 | Cysewski | 49/340 X |
| 5,131,187 | 7/1992 | Agnew et al. | 49/340 X |
| 5,263,281 | 11/1993 | Osborn | 49/340 X |
| 5,299,386 | 4/1994 | Naegelli et al. | 49/28 |
| 5,440,838 | 8/1995 | Lesser | 49/340 |

*Primary Examiner*—Jerry Redman

*Attorney, Agent, or Firm*—Richard A. Ryan

[57] ABSTRACT

A gate operator for lifting a gate about a horizontal axis at a lower proximate corner thereof to vertically raise and lower a gate in a generally 90 degree arc in the plane of the gate by using a fractional horsepower motor and an energy accumulator, which can be a torsion motor, a pneumatic mechanism or an enclosed spring mechanism. The motor is only used to initiate movement in the upward and downward cycles of the gate and to regulate the speed of the gate by damping the release of accumulated energy. A drive mechanism connects the motor to the energy accumulator. Energy is stored to the energy accumulator during the downward movement of the gate and released during the upward movement of the gate to reduce the amount of power required to operate the gate. The stored energy in the energy accumulator balances the gate such that it is held in a virtual weightless condition in all positions of its arcuate movement, allowing the gate to be moved from or to its open or closed position with a minimal amount of energy. The drive mechanism locks the gate in its open vertical position and in its closed horizontal position.

28 Claims, 6 Drawing Sheets

GATE OPERATOR FOR VERTICAL GATE MOVEMENT

BACKGROUND OF THE INVENTION

1. Field of the Invention

The field of the present invention relates generally to gate operators that raise and lower gates to allow passage through a gate opening. More particularly, the present invention relates to gate operators that vertically raise and lower a gate about a horizontal axis wherein the gate raises and lowers in a generally 90 degree arc by the power of a fractional horsepower motor. Even more particularly, the present invention relates to gate operators that utilize the weight of the gate during the gate lowering process to store energy in an energy accumulator mechanism for use in raising the gate.

2. Background

Gate operators are commonly used to open and close security gates or other barriers, such as crossing arms, to control ingress and egress from residential, business, industrial, recreational and ranch properties. Gate operators open and close gates in a variety of different manners. Many gate operators open and close the gate by moving it in a horizontal or linear direction or by swinging the gate across the gate opening by pivoting the gate around a vertical axis. These gate operator systems require sufficient space around the gate and gate mounting structure to allow the gate to move between the open and closed positions. Because the gate must move across the surface of the ground, the build-up of various materials around the gate structure, such as snow, sand and dirt, can cause problems for operation of the gate if the build-up prevents free movement of the gate.

To avoid the problems associated with gate operators that open the gate in a horizontal or linear direction or around a vertical axis, some gates open vertically by pivoting around a generally horizontal axis. Typically, these gates are mounted on the gate structure to allow the gate to pivot between the open and closed positions such that the gate pivots up to open and down to close. One benefit of this type of gate operator is that movement of the gate is not impeded by snow, sand, dirt or the like in the roadway leading to or from the gate or around the gate structure. An additional benefit of this type of gate operator is that use of the gate is not limited by the sloping topography of the roadway across which the gate extends. Further benefits of this type of gate operator is that it reduces the amount of space required for the gate along the roadway and gate structure and has minimal site preparation requirements. Because these type of gate operators move the gate within its own space, there is reduced impact on the associated landscaping.

Often security gates are utilized in remote areas that are not served or not reliably served by electrical power. Consequently, many security gates rely on battery or other remotely available power supplies to supply electrical power to an electric motor. To ensure that power is available to the gate operator when needed, it is important for the gate operator motor to have relatively low power consumption.

An example of a vertically opening gate operator is found in U.S. Pat. No. 4,779,379 to Steen. This patent describes a gate operator for raising or lowering a gate about a horizontal axis located near the lower proximate corner of the gate. The gate operator lifts the gate in a 90 degree arc in the plane of the gate using a large belt-driven pulley, a vertical raceway on the face of the driving wheel and a linkage mechanism. This gate operator is configured to counterbalance the weight of the gate through use of a number of springs that serve to make the gate effectively weightless in all positions of its arcuate movement, such that the gate operator requires a minimum amount of force, and as a result electrical power, to move the gate between the open and closed positions.

Although the vertical movement gate operator described above avoids some of the problems associated with gate operators that move the gate in a horizontal or linear direction or swing the gate about a vertical axis, it has a number of problems that have prevented it from being widely utilized. These problems include an opening and closing mechanism that is relatively difficult to install, typically requiring more than one site visit, and operate, such that it has a tendency to be somewhat troublesome during operation. In addition, this gate operator is difficult to regulate and adjust for a given gate length, weight and design. The gate operator described in U.S. Pat. No. 4,779,379 is complicated to adjust, having three adjustment points, various lever fulcrums and chain variations. Consequently, a need exists for a gate operator that has the benefits of a vertical movement gate operator, including relatively compact gate size and low power consumption, that is simple to install and operate and less subject to problems.

SUMMARY OF THE INVENTION

The gate operator of the present invention solves the problems identified above. That is to say, the present invention provides a gate operator that raises and lowers the gate about a horizontal axis to achieve the benefits of relatively compact operation and low power consumption. In addition, the gate operator of the present invention is simpler to install, having single point adjustment, regulate, balance and adjust for a broad range of gate sizes, weights and designs. The simplified construction and reduction in weight allows the gate operator to be installed in a single site visit and provides for easy balance adjustment. The gate of the present invention is also less subject to operating problems than prior art gate operators. The gate operator of the present invention is a further improvement over prior art gate operators in that it is easier to manufacture, because it does not require the critical tolerances and eliminates a number of moving parts, and further reduces the amount of power consumption required to move the gate from a closed (horizontal) to an open (vertical) position and back to the closed position.

The gate operator of the present invention raises and lowers a gate about a horizontal pivotal axis such that the gate swings through a 90 degree arc in a vertical plane from a horizontal closed position to a vertical open position to allow passage through the gate and the reverse to prevent access through the gate. A fractional horsepower motor, powered by a battery or the like, drives a drive mechanism that connects to the gate to initiate the movement to raise and lower the gate for ingress and egress through the gate opening. A cam and raceway are provided to increase the mechanical advantage of the drive mechanism and decrease the speed of the gate at the extremes of the open and closed positions. A gear mechanism connects the drive mechanism to a mechanical energy accumulator, such as one or more torsion bars, a pneumatic mechanism or an enclosed spring mechanism, to store energy during the downwardly movement of the gate and release the stored energy during the upwardly movement of the gate to reduce the power consumption necessary to raise the gate for passage therethrough.

In the preferred embodiment, the present invention utilizes a belt-driven pulley drive mechanism and cam raceway mechanism operatively connected to the energy accumulator by a pair of beveled gears to store energy during the lowering of the gate in order to reduce the amount of power necessary to raise the gate. The present invention eliminates the numerous spring mechanisms needed to counterbalance the gate and the linkage mechanism necessary to operate and obtain the benefits of the prior art gate operator. The elimination of these mechanisms results in a single point of adjustment rather than the three or more required in prior art devices, resulting in reduced installation and adjustment for the gate operator to function correctly. In addition, the elimination of these mechanisms reduces the troublesome nature of the prior art vertical movement gate operators. The improvements found in the present invention reduce the cost of manufacturing and allow the average mechanically sophisticated individual to install and adjust. The significant weight reduction of the present gate operator ensures constant balance factor throughout the entire 90 degree arc of gate rotation.

Accordingly, the primary objective of the present invention is to provide a vertically opening gate operator that utilizes an energy accumulator to store energy to reduce power consumption and provide smooth operation of the gate.

It is also an important objective of the present invention to provide a gate operator that raises and lowers a gate about a horizontal axis while maintaining a constant balance factor through the gate's 90 degree of travel.

It is also an important objective of the present invention to provide a gate operator that counterbalances the weight of the gate to provide a weightlessness-like operation of the gate during a portion of the 90 degree arc of rotation of a vertically opening gate.

It is also an important objective of the present invention to provide a vertically opening gate operator that is easy to install and set-up for a broad range of gate sizes, weights and designs and which provides virtually trouble-free operation of the gate system.

Yet another important objective of the present invention is to provide a gate operator that utilizes a fractional horsepower motor connected to a drive mechanism and a mechanical energy accumulator to raise and lower a gate about a horizontal axis.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
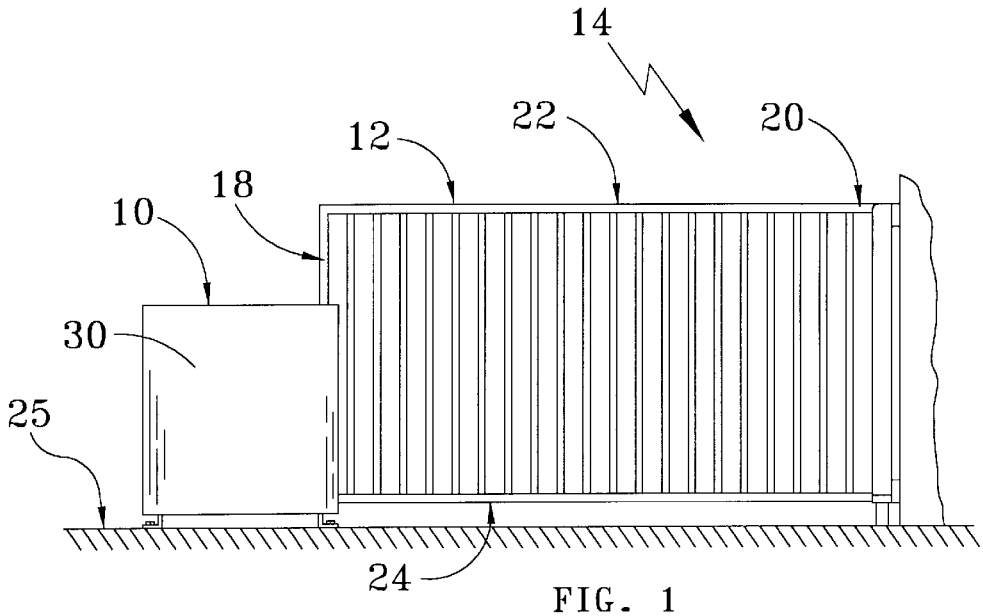
FIG. 1 is a side view of the gate operator of the present invention showing a gate in a horizontal closed position.
Figure 2:
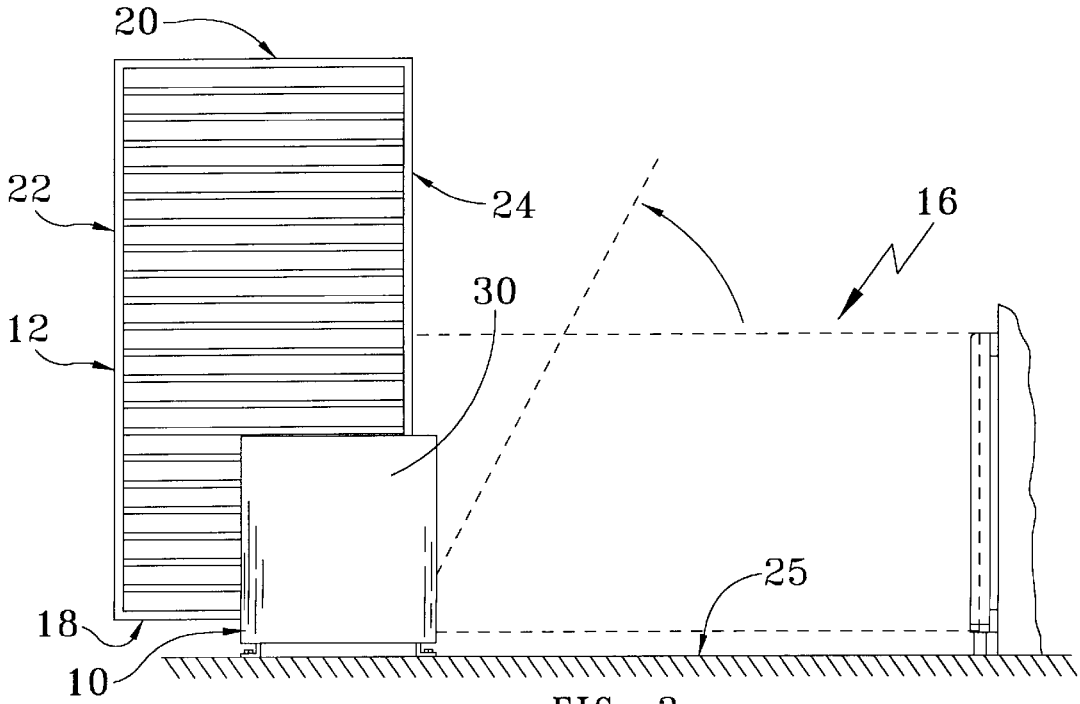
FIG. 2 is a side view of the gate operator of the present invention showing a gate in a vertical open position.
Figure 3:
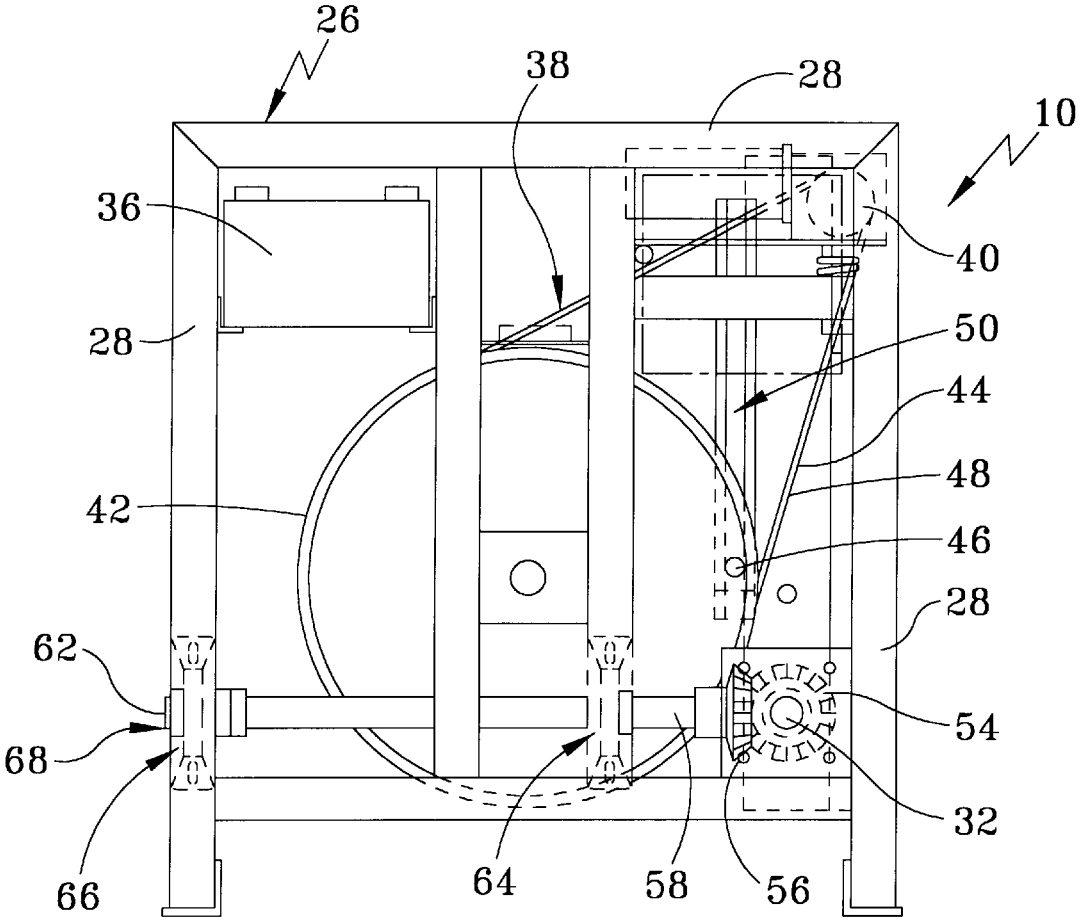
FIG. 3 is a detail side view of the gate operator of the present invention.
Figure 4:
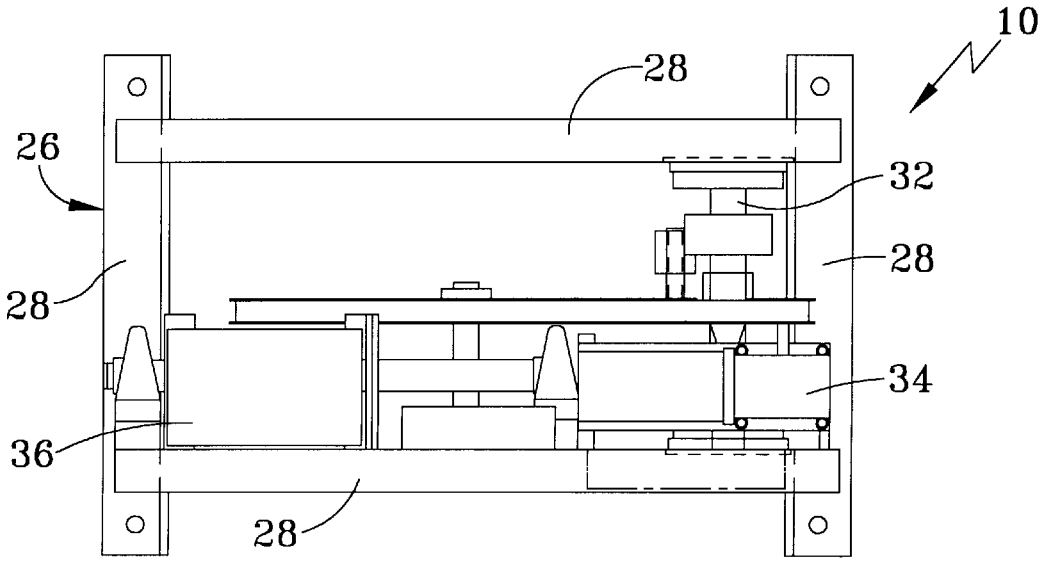
FIG. 4 is a top view of the gate operator of the present invention.
Figure 5:
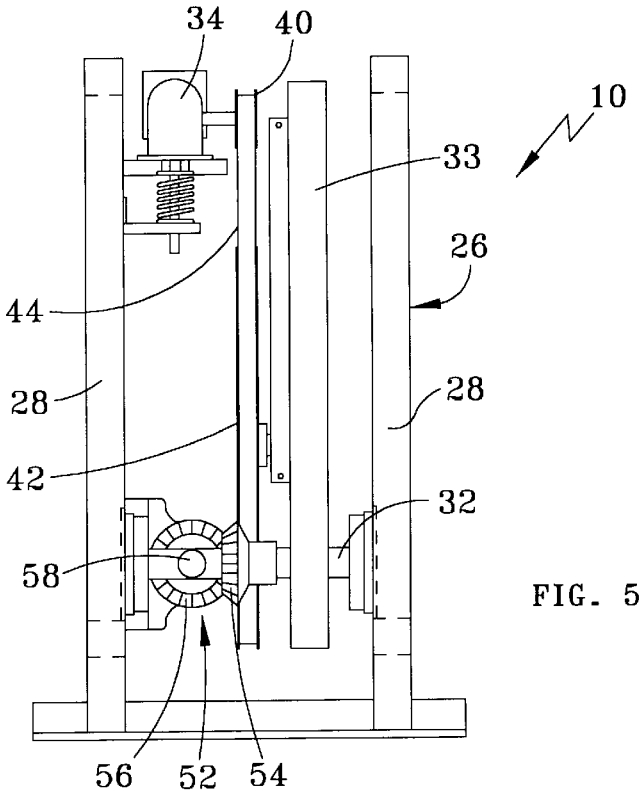
FIG. 5 is a front view of the gate operator of the present invention with the gate (not shown) in the raised vertical open position.

With reference to the figures where like elements have been given like numerical designations to facilitate the reader's understanding of the present invention, and particularly with reference to the embodiment of the present invention illustrated in FIGS. 1 through 5, the preferred embodiment of the present invention is set forth below. The gate operator, designated generally as 10, is designed and configured to raise gate 12 from its horizontal closed position 14, shown in FIG. 1, to the vertical open position 16, shown in FIG. 2, through a substantially 90 degree arc in the general vertical plane of gate 12. Gate 12 can be any of any type, size or weight, such as those which are commonly available for use as security gates, barriers, crossing arms and the like. The gate 12 has a proximal end 18 closest to the gate operator, a distal end 20 opposite proximal end 18, a top edge 22 and bottom edge 24. In the horizontal closed position 14, bottom edge 24 of gate 12 is at or near and substantially parallel with surface 25 of the roadway, path or other mode of ingress and egress through the gate.

A gate structure 26 made up of a plurality of frame members 28 supports a housing 30 that can be fully or partially enclosed to protect the operating equipment inside from exposure to the elements. Attached to the gate structure is a pivot element 32 having a substantially horizontal axis. Pivot element 32 pivotally connects to gate support member 33, which is connected to or integral with gate 12, to raise and lower the gate 12 about the horizontal axis. The pivot element 32 must be of sufficient size and strength to pivotally support gate 12 during its arcuate rotation between the horizontal closed position 14 and the vertical open position 16.

Also attached to or inside the gate structure 26 is a small motor 34, which can be of any type that is suitable for supplying sufficient power to raise gate 12 from closed position 14 to open position 16, whether electric, gas or any other type of power supply. In the preferred embodiment motor 34 is a small electric motor, such as a fractional horsepower electric motor, that is suitable for being powered by battery 36. Motor 32 is drivingly connected to a drive mechanism 38 suitable for rotating the gate. However, motor 32 is not required to be of sufficient size to raise or lower gate 12. Motor 32 is only required to be able to position gate 12, by moving it slightly up or down while it is balanced, and control the release of torque from the energy accumulator.

One configuration for drive mechanism 38 is the use of small first wheel 40 (i.e., a pinon wheel) and large second wheel 42 (i.e., a bull wheel). First wheel 40 and second wheel 42 are pivotally attached to gate structure 26. The edges of wheels 40 and 42 can be grooved to facilitate interconnecting wheels 40 and 42 with belt 44. The outer edge of first wheel 40 can have a v-shaped configuration and second wheel 42 can have a flat or planar configuration with belt 44 being v-shaped to allow second wheel 42 to slip to provide clutch-type operation. Drive mechanism 38 should provide a mechanical advantage to minimize the amount of power required by motor 32 to raise gate 12. In the preferred embodiment of the present invention, drive mechanism 38 has a series of levers 45 interconnecting second wheel 42 and gate support member 33 to rotate gate support member 33, and therefore gate 12, about pivot 32 to open or close gate 12. Alternatively, drive mechanism 38 can also comprise a cam, such as roller cam 46, attached to the face of second wheel 42 and moveably disposed between a pair of spaced apart vertical bars 48 attached to or integral with gate 12 to form raceway 50. The cam 46 moves along raceway 50 in response to the rotation of second wheel 42, thereby pivoting gate support structure 33 to raise or lower gate 12. The cam also provides a safety benefit in case of a malfunction of any part of the drive mechanism 38.

Also included within gate structure 26 is gear mechanism 52 having a first beveled gear 54 and a second beveled gear 56. First gear 54 is attached to or integral with pivot 32 such that as gate 12 raises or lowers it rotates pivot 32 causing rotation of first gear 54. First gear 54, being in a geared relationship with second gear 56, causes second gear 56 to rotate also. Second gear 56 is connected to or integral with torsion bar 58.

In the preferred embodiment of the present invention, torsion bar 58 has a circular cross-section, although other configurations, such as square or rectangle are possible. As second gear 56 rotates, in response to the rotation of first gear 54 during the lowering of gate 12, energy is accumulated and stored in the partial rotation or twist of torsion bar 58. A change in the gear ratio between the first 54 and second 56 gears changes the capacity for storing energy and the rate of energy accumulation. During the upward movement of gate 12, the energy is released from torsion bar 58 to supply force to raise gate 12 and reduce the amount of electrical energy required. Connected to torsion bar 58 is an adjusting mechanism 60 that, in the preferred embodiment, comprises a bolt 62 having a nut-like head connected to torsion bar 58 to allow the installer to manually rotate torsion bar 58 to pre-load it with a desired amount of twist (stored energy). Torsion bar 58 rotates inside a first internally rotatable bearing 64 and second internally rotatable bearing 66.

Because there is a limit on the amount of energy that can be stored in torsion bar 58, due to the limit on the amount of degrees rotation for a specific length of torsion bar 58 without breaking or damaging torsion bar 58, a second torsion bar (not shown) can be nested with torsion bar 58 to get an increase in effective length without having to increase the length of support structure 26. Nesting of torsion bar 58 with a second torsion bar becomes necessary for larger sized gates to avoid the need to have torsion bar 58 be excessively long and result in a loss of some of the benefits described herein. In the nesting configuration, the torsion bars should be nested with appropriate arrangement of gears, levers and torsion bars to achieve the desired gate lifting capacity. The gearing mechanism, such as a partial gearing system, should be configured such that when torsion bar 58 reaches approximately 80% of its maximum stress, it engages a second torsion bar (not shown) to obtain the full amount of energy storage needed.

In use, after installation of gate operator 10 and gate 12, the user pre-loads torsion bar 58 by twisting bolt 62 to rotate (i.e., twist) torsion bar 58 and locks the pre-loaded torsion bar 58 into place with a pin, bar etc. so that the gate operator 10 will not lose adjustment. The user adjusts the amount of force accumulated in torsion bar 58 such that the gate 12 will be effectively weightless at or about its halfway point between the horizontal closed position 14 and the vertical open position 16. Starting in the closed position 14, as the user initiates the gate opening (i.e., by remote or manual switching), motor 34 is switched on to initiate the upward movement of gate 12. After the initial upward movement, which is supplied by motor 10 to rotate second wheel 42 to just past its midway point, the gate 12 is effectively counterbalanced by the force in torsion bar 58. During the upward movement of gate 12, torsion bar 58 transmits its stored energy to the lifting of the gate, thereby not requiring any power from motor 34. Although motor 34 is not used to move gate 12 after the initial start, it does function to regulate the speed of the gate movement by damping the release of accumulated energy. Motor 34 can supply power at the end of the upward cycle to set the gate in a locked, fully open position. As second wheel 42 rotates past its midway point, gate 12 is locked in the open position 16. Once gate 12 is locked in the open position 16, the user can safely pass through.

After the user passes, gate 12 begins its downward movement with the initial motion being supplied by motor 34 to move second wheel 42 to unlock gate 12 from the open position 16. During the downward movement, the rotation of pivot 32 rotates first gear 54, which then rotates second gear 56 to store energy in torsion bar 58 (i.e., by twisting torsion bar 58). The motor 34 can supply power to bring gate 12 to the fully closed position with the gate 12 at or near the ground surface. As second wheel 42 rotates past its midway point in the down cycle, gate 12 is locked into closed position 14 to prevent unauthorized entry through gate 12 by merely lifting gate 12. When the gate is in the horizontal closed position 14, the torsion bar 58 is storing energy for the next up and down cycle of gate 12.

The adjustment and movement of the gate operator 10 of the present invention is much simpler, more direct and more reliable than the adjustment and movement of prior art gate operators. Adjustment of the gate operator 10 only requires the user to unlock the pin mechanism that was used to pre-load the torsion bar 58, twist the bolt 62 for proper torsion and then re-setting the pin mechanism to lock the torsion bar 58 in place. The prior art mechanism, described in U.S. Pat. No. 4,779,379 to Steen, requires a much more complicated adjustment procedure that results in a restricted market for the device. Other benefits of the gate operator of the present invention over the various prior art gate operators include less weight for the gate operator, easier manufacturing, silent operation, increased flexibility, its relatively small size and the ability of a user with only moderate mechanical ability to regulate the gate operation with conventional tools.

Figure 6:
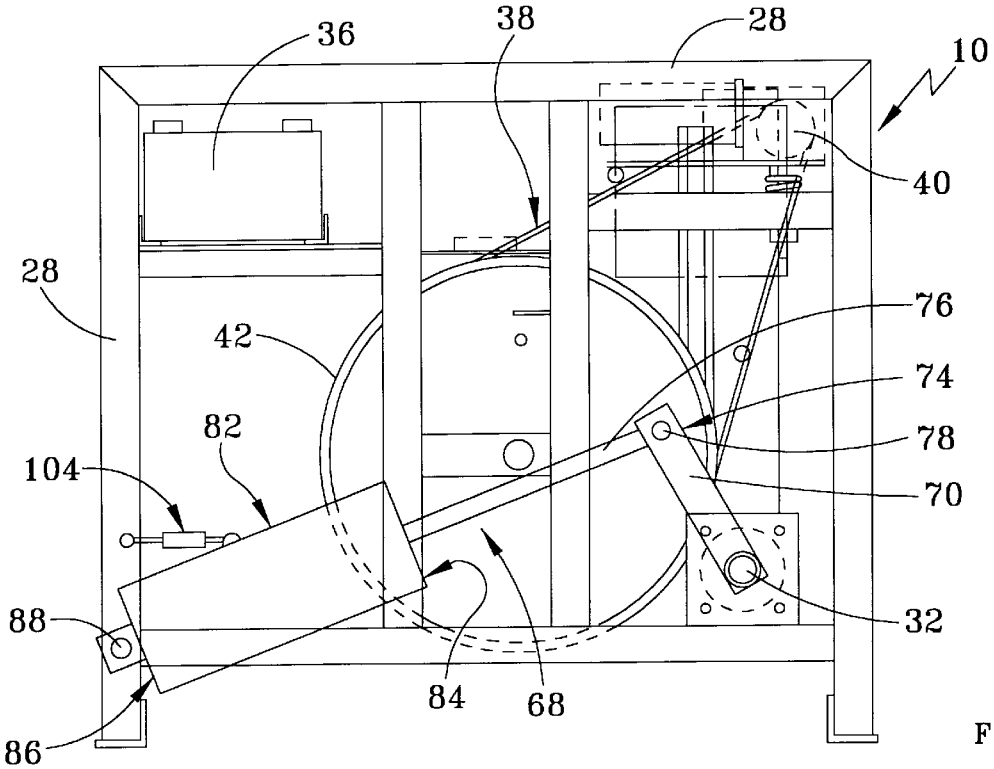
FIG. 6 is a side view of an alternative embodiment of the gate operator of the present invention with the gate (not shown) in a horizontal closed position.
Figure 7:
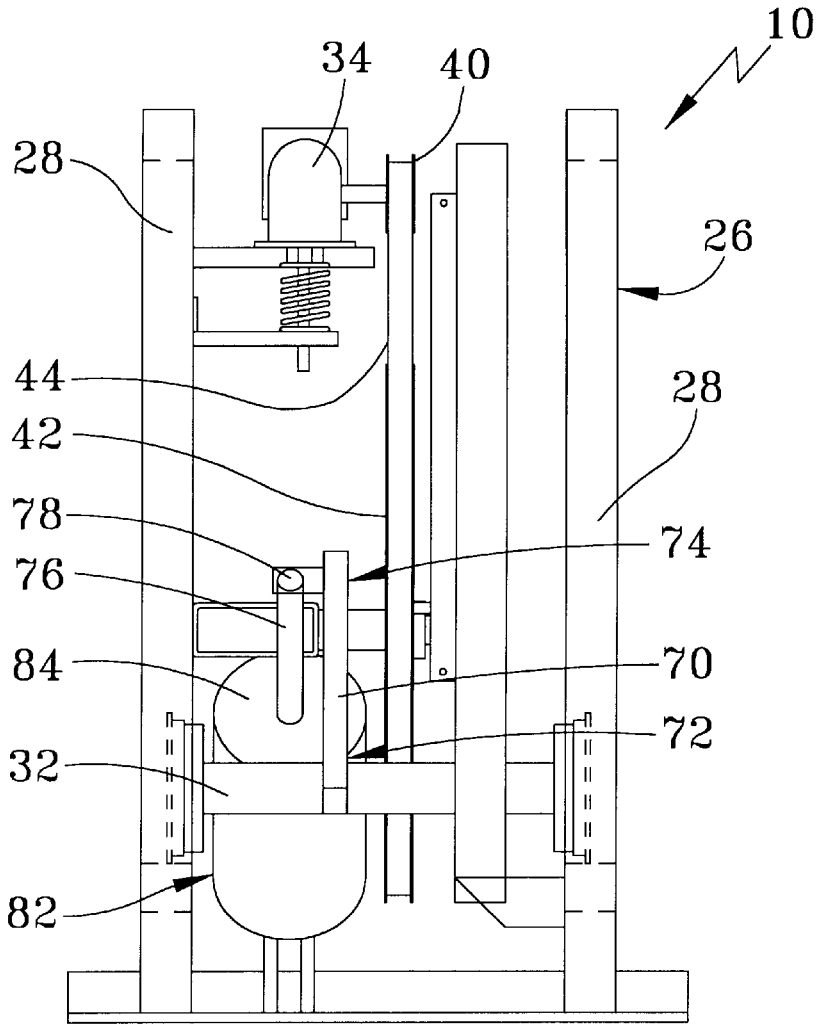
FIG. 7 is a side view of the gate operator of the embodiment of the invention from FIG. 6 showing a gate in a vertical open position.
Figure 8:
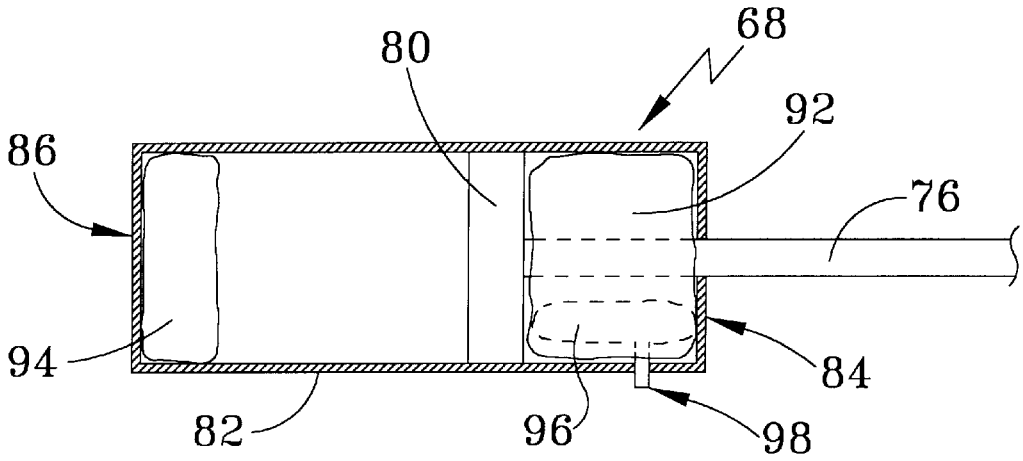
FIG. 8 is a detail view of the hydraulic mechanism of the embodiment of the invention shown in FIGS. 6 and 7.

In an alternative embodiment of the present invention, the gate operator 10 utilizes a pneumatic mechanism, shown collectively as 68 in FIGS. 6–8, in place of the torsion bar 58 and the first 54 and second 56 beveled gears to accumulate energy for raising gate 12. In this embodiment, a lever arm 70 having a first end 72 connected to pivot 32 such that as pivot 32 rotates, it rotates lever arm 70. Second end 74 of lever arm 70 is pivotally connected to one end of shaft 76 with pivot pin 78 such that as lever arm 70 rotates, shaft 76 is moved in an axial direction. The opposite end of shaft 76 is connected to piston 80, which is slidably received in cylinder 82. Shaft 76 is axially aligned with cylinder 82 and received at the proximal end 84 of cylinder 82. The proximal end 84 of cylinder 82 should be closed except for an opening to allow shaft 76 to move in and out of cylinder 82. The distal end 86 of cylinder 82 is also closed and has a pivot mechanism 88 that pivotally connects the distal end 86 to a frame member 28.

In the preferred configuration of this embodiment, as shown in FIG. 6 with the gate in the horizontal closed position 14, the counter-clockwise rotation of pivot 32 from the upward movement of gate 12 rotates lever 70 in a counter-clockwise direction to push shaft 76 in an axial direction, thereby pushing piston 80 inside cylinder 82 towards the distal end 86 of cylinder 82. The pivot mechanism 88 allows cylinder 82 to pivot clock-wise as piston 80 slides toward distal end 86. This movement continues until mechanism 68 is in the position shown in FIG. 7 when gate 12 is in its vertical open position 16.

To improve the energy accumulation and gate operation characteristics of hydraulic mechanism 68, inside cylinder 82 are one or more bladders 90 for storing and releasing compressed gas, preferably a gas such as nitrogen. As shown in FIG. 8, the preferred configuration of this embodiment utilizes three separate bladders inside cylinder 82. Primary bladder 92 is disposed between the piston 80 and the proximal end 84 of cylinder 82 and around that portion of shaft 76 inside cylinder 82. Primary bladder 92 should be manufactured of a flexible material, such as neoprene or similar materials, and can have an elongated inner tube or donut shape to allow the shaft 76 to move within cylinder 82 without damaging or interfering with primary bladder 92. Also inside cylinder 82, but on the opposite side of piston 80 (i.e., the distal side of piston 80) disposed between distal end 86 of cylinder 82 and piston 80, is secondary bladder 94. Secondary bladder 94 is a bag-like bladder that, like primary bladder 92, contains gas and is made of neoprene or similar material. To facilitate compression and decompression of the primary 92 and secondary 94 bladders, piston 80 can be convexly shaped at the surfaces that abut the bladders. A third bladder, adjustment bladder 96, is disposed inside primary bladder 92 and is used to adjust the volume of air that is inside primary bladder 92. Primary bladder 92 and secondary bladder 94 are closed to the atmosphere and can be filled prior to delivery to the user. Adjustment bladder 96 has an inlet means 98 that opens to the exterior of cylinder 82 to allow gas to be added to or removed from adjustment bladder 98.

Figure 9:
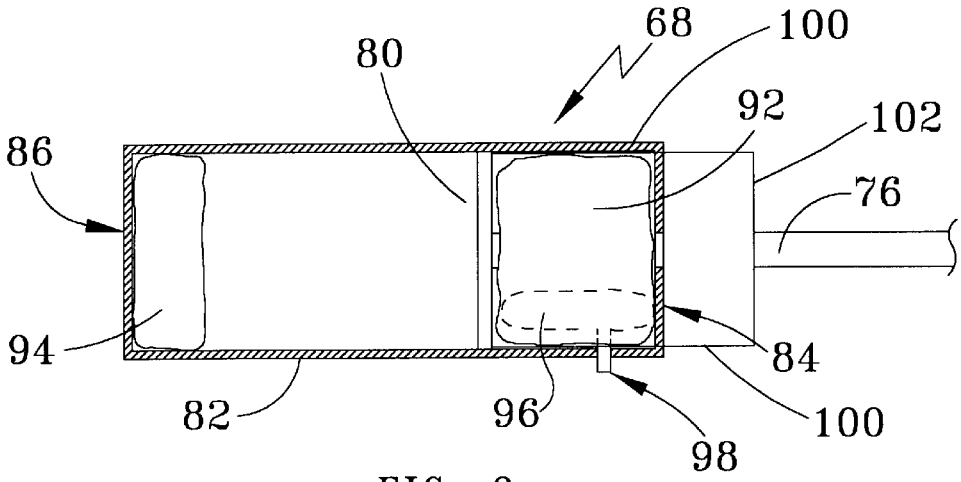
FIG. 9 is a detail view of an alternative hydraulic mechanism for the embodiment of the invention shown in FIGS. 6 and 7.

To reduce manufacturing costs and the potential for damage to primary bladder 92, it may be preferred to utilize the hydraulic mechanism configuration shown in FIG. 9. In the embodiment of the present invention shown in FIG. 9, primary bladder 92 is an enclosed bladder (not the elongated inner tube or donut shaped bladder shown in FIG. 8) that is disposed in cylinder 82 between piston 80 and the proximal end 84 of cylinder 82. Piston 80 can be a flat plate that is connected to two or more rods 100 that are connected to cross-member 102, which is connected to shaft 76. Alternatively, rods 100 can be shaped and configured to connect directly to shaft 76 without cross-member 102. Energy is stored by the compression of primary bladder 92 that occurs when piston 80 is pulled towards the proximal end 84 of cylinder 82 during the downward movement of gate 12. As in the configuration shown in FIG. 8, the configuration shown in FIG. 9 can have the secondary bladder 94 at the distal end 86 of cylinder 82 and the adjustment bladder 96 inside primary bladder 92.

In use, starting from the horizontal closed position 14 with gate 12 down, as shown in FIG. 6, motor 34 initiates the upward movement of gate 12 by rotating second wheel 42 to unlock gate 12 and move pivot 32 and rotate lever 70 to push shaft 76 in an axial direction to move piston 80 towards the distal end 86 of cylinder 82. After the initial movement caused by motor 34, the movement of piston 80 is accomplished by the release of stored energy from compressed air inside primary bladder 92. The expansion of primary bladder 92 forces piston 80 towards distal end 86, thereby pulling shaft 76 and rotating pivot 32 to continue the upward movement of gate 12 until it is set in the locked vertical open position 16, shown in FIG. 7. As piston 80 moves toward distal end 86, it compresses secondary bladder 94 to store energy to start gate on the downward portion of its cycle. It is only necessary to store energy for the downward portion of the cycle, by compressing secondary bladder 94, at the end of the upward cycle of gate 12 due to the relatively low amount of energy required to start gate 12 down.

At the beginning of the downward cycle, with gate 12 in its locked vertical open position 16, motor 34 initiates movement of pivot 32 in a clock-wise direction to move shaft 76 and piston 80 away from distal end 86 of cylinder 82 and unlock gate 12 from its open position 16. After this initial movement, release of energy stored in the compressed gas in secondary bladder 94 continues the downward movement of gate 12. As gate 12 moves toward the horizontal closed position 14, the gas in primary bladder 92 is compressed and energy is stored for raising gate 12. Different gate sizes and weights will require different amounts of volume of compressed gas inside primary bladder 94. To provide for varying this varying volume requirement, primary bladder 94 can be provided with an means for adjusting the volume of gas available for compression inside primary bladder 94. One such means is a separate adjustment bladder 96 that has an inlet mechanism 98 that is accessible from outside of cylinder 82. The size of adjustment bladder 96 can be increased or decreased by adding or removing gas from inside adjustment bladder 96 through the inlet mechanism 98. By increasing the size of adjustment bladder 96, the volume of gas available for compression, and therefore for storing energy, is decreased. The reverse is also true. An independent adjustment bladder 96, as opposed to merely adjusting the primary bladder 92 itself, is preferred due to the ability to keep the primary bladder 92 sealed to avoid moisture or dust from entering the primary bladder 92 during the addition or removal of gas to adjust the volume.

The shaft 76 should be made of a stiff material such as metal or hard plastic (or other materials) such that movement of pivot 32 will transmit to axial movement of shaft 76 and movement of piston 80 inside cylinder 82. For smooth operation and to avoid problems with freezing, the gas inside bladders 90 can be nitrogen. Nitrogen has the advantage of having smoother compression and release of pressure compared to air and is less likely to have moisture that can result in freezing problems. Nitrogen and other gasses generally avoid the fluctuation in properties that liquids can experience during the change in temperature from day to night. Any fluctuations that result from using nitrogen will not affect the gate operator operation because motor 34 is used to put gate 12 in the final open or closed positions.

To maintain constant pressure in secondary bladder 94 in order to have constant pressure at the bottom of the travel of piston 80 (to avoid excessive pressure that could interfere with the opening of gate 12), a piston-operated pressure relief valve 104 can be utilized. Pressure relief valve 104 can be configured to add pressure to secondary bladder 94 when the pressure in bladder 94 drops below a certain level and to release pressure from bladder 94 when the pressure inside exceeds a certain level. The piston portion of relief valve 104 can be located near cylinder 82 and disposed between frame member 28 and cylinder 82 such that movement of cylinder 82 will mechanically actuate the piston to add pressure as necessary. Alternatively, the piston portion of relief valve 104 can be disposed between frame member 28 and lever 70 such that movement of lever 70 will mechanically actuate the piston inside valve 104 to supply pressure to secondary bladder as needed. Other locations for relief valve 104 are also possible.

In an alternative embodiment, secondary bladder 94 can be located outside cylinder 82. One such location is between gate support member 33 and a frame member 28 so that as gate support member 33 pivots gate 12 to the vertical open position 16, gate support member 33 compresses secondary bladder 94 to provide stored energy to assist in the downward movement of gate 12 after motor 34 moves gate 12 out of its locked open position 16. Its exact position can be adjustable to allow for various weights of gate 12. To protect secondary bladder if not placed inside cylinder 82, it can be enclosed in its own cylinder, tube or other enclosure (not shown). Other locations, besides between gate support member 33 and frame member 28, are also possible.

Figure 10:
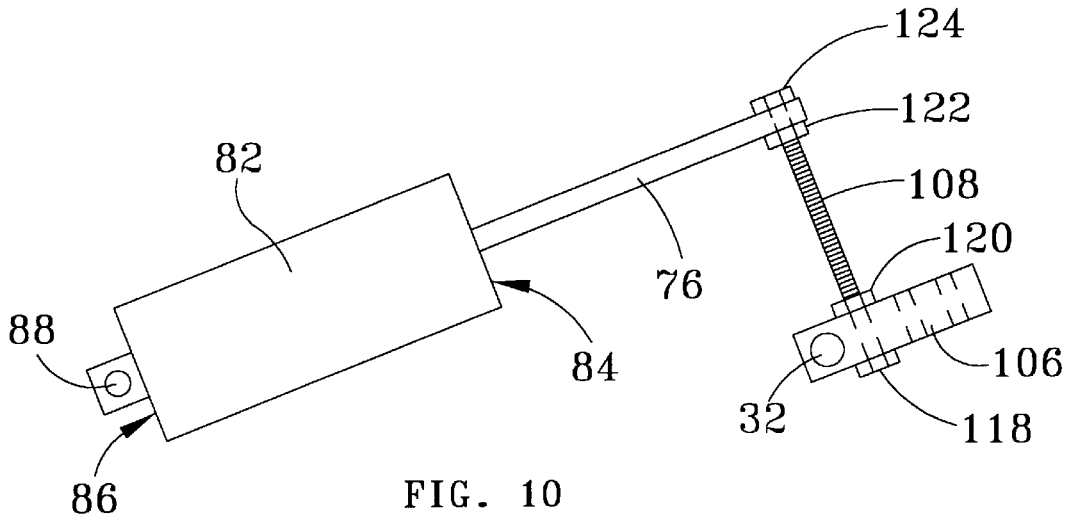
FIG. 10 is a side view of an adjustment mechanism for use in an alternative embodiment of the gate operator of the present invention with the gate (not shown) in a horizontal closed position.
Figure 11:
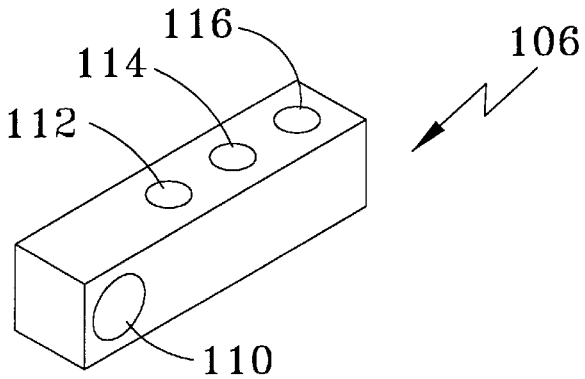
FIG. 11 is a perspective view of the adjustment arm of the embodiment shown in FIG. 10.

To provide further adjustment ability for different size and weight gates, gate operator 10 can utilize an adjustment mechanism, comprised primarily of adjustment arm 106 and threaded lever 108, as shown in FIGS. 10 and 11. As illustrated in FIG. 10, the adjustment mechanism described herein is interconnects pivot 32 and shaft 76 such that as pivot 32 rotates it rotates adjustment arm 106 to cause shaft 76 to move piston 80. Movement of piston 80 in response to the release of energy from primary bladder 92 (or the spring mechanism discussed below) will cause threaded lever 108 to rotate adjustment arm 106 and pivot 32, which will raise gate 12. Adjustment arm, shown in detail in FIG. 11, has pivot opening 110 in which pivot 32 is received to facilitate welding or otherwise connecting adjustment arm 106 to pivot 32. Also located on adjustment arm 106 is at least one adjustment opening. In FIG. 11, three such openings, first opening 112, second opening 114 and third opening 116, are shown. One end of threaded lever 108 is placed through one of the openings and secured by first nut 118 and first lock nut 120. Shaft 76, which has an opening at its end, connects to threaded lever 108 with the use of second nut and second lock nut. The position where shaft 76 connects to threaded lever 108 is adjusted to obtain the desired right angle between threaded lever 108 and shaft 76. The location of threaded lever 108 in adjustment arm 106 is selected depending upon the weight of gate 12. Moving threaded lever 108 away from pivot 32 proportionately increases the mechanical lifting advantage available from the stored energy in cylinder 82 to be able to lift gate 12 of greater weights. In this manner, the same configuration for gate operator 10 can be used for different sized gates.

Figure 12:
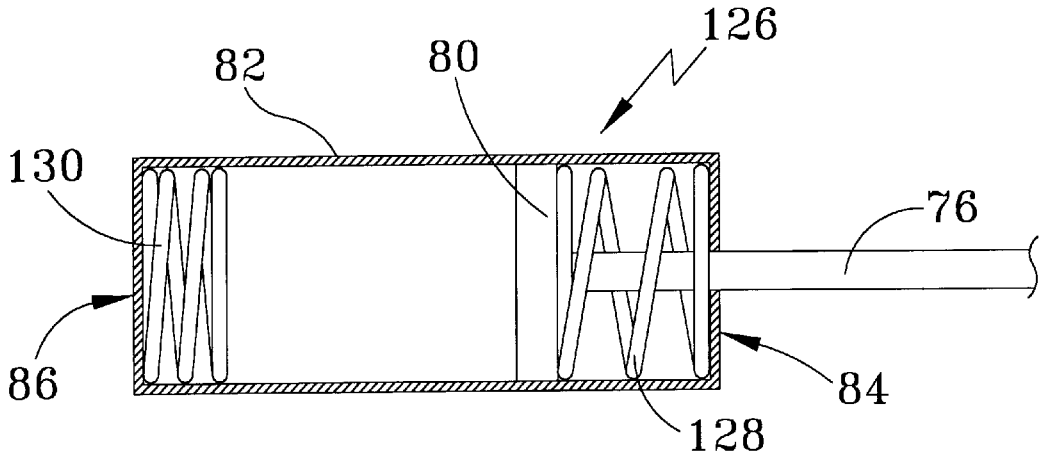
FIG. 12 is a detail of an enclosed spring mechanism for an alternative embodiment of the present invention.
Figure 13:
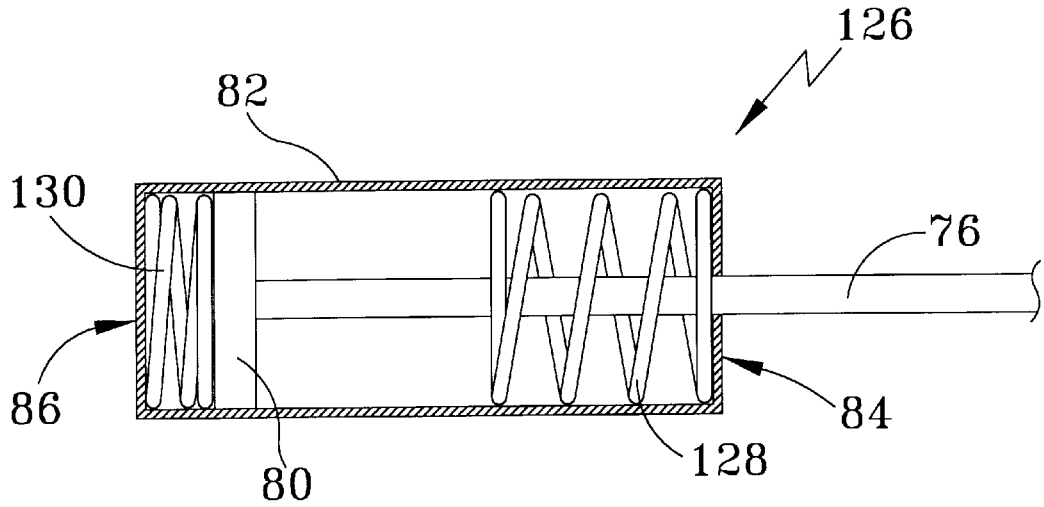
FIG. 13 is a detail of the mechanism shown in FIG. 12 showing compression of the second spring.

Another alternative embodiment for the energy accumulator of the present invention is shown in FIGS. 12 and 13. Instead of utilizing the pneumatic mechanism described above and illustrated in FIGS. 6–8, an enclosed spring mechanism (shown collectively as 126) can be used. Spring mechanism 126 can utilize shaft 76, piston 80 and cylinder 82 described above and further comprise primary spring 128 and secondary spring 130, both of which are compression springs. Primary spring 128 is disposed between piston 80 and proximal end 84 of cylinder 82 such that as gate 12 lowers and causes shaft 76 to move piston 80 towards proximal end 84, primary spring 128 is compressed and energy for lifting gate 12 is stored therein, as shown in FIG. 12. When gate 12 is to be raised to its vertical open position 16, the initial movement supplied by motor 34 unlocks gate 12 and allows primary spring 128 to release the energy stored therein and push piston 80 towards the distal end 86 of cylinder 82 to provide force to lift gate 12. After approximately 60 degrees of rotation, primary spring 128 no longer does any work and piston 80 moves to distal end 86 without primary spring 128 following. At distal end 86, piston 80 compresses second spring 130 to provide energy to start gate 12 on its downward cycle.

In one embodiment of the enclosed spring mechanism 126, cylinder 82 can have a outside diameter of 3½ inches and enclose a 1¼ inch inside diameter primary spring 128 that accumulates energy at the rate of 100 pounds per inch of compression, is approximately eleven inches long and can compress to approximately five inches. The six inches of compression provides lifting force of 600 pounds. If the adjustment mechanism described above and shown in FIGS. 10 and 11 is utilized, the amount of force available to lift gate 12 can be somewhat increased. Second spring 130, requiring less force, can comprise a 1⅛ inch inside diameter compression spring that is approximately four inches in length and stores energy at the rate of ten pounds per inch. The above are examples of spring configurations that can be used, other styles, types or sizes of gates can require alternate sizes and configuration for the various components. In an alternative embodiment, second spring 130 can be located outside cylinder 82. One such location is between gate support member 33 and a frame member 28 so that as gate support member 33 pivots gate 12 to the vertical open position 16, gate support member 33 compresses second spring 130 to provide stored energy to assist in the downward movement of gate 12 after motor 34 moves gate 12 out of its locked open position 16. Its exact position can be adjustable to allow for various weights of gate 12. To protect second spring 130 if not placed inside cylinder 82, it can be enclosed in its own cylinder, tube or other enclosure. Other locations, besides between gate support member 33 and frame member 28, are also possible. Alternatively, second spring 130 can be eliminated altogether and replaced with a mechanism for deflection of cylinder 82 at the time gate 12 approaches the vertical open position 16.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A gate operator for use in combination with a gate for raising and lowering said gate about a horizontal axis, said gate operator comprising:

a gate structure having a pivot member pivotally connected to a proximal end of said gate for rotation of said gate between a horizontal closed position and a vertical open position;

a motor;

drive means connecting said motor to said gate for moving said gate between said horizontal closed position and said vertical open position;

one or more torsion bars; and gear means for operatively connecting said drive means to said one or more torsion bars, said gear means configured to store energy to one or more torsion bars during the movement of said gate from said vertical open position to said horizontal closed position.

2. The gate operator according to claim 1, wherein said drive means comprises a first pulley operatively connected to a second pulley.

3. The gate operator according to claim 1, wherein said drive means comprises a roller cam disposed in a raceway.

4. The gate operator according to claim 3, wherein said drive means further comprises a first pulley operatively connected to a second pulley, said roller cam and said raceway connecting said second pulley to said gate to move said gate between said horizontal closed position and said vertical open position upon rotational movement of said second pulley.

5. The gate operator according to claim 1 further comprising adjustment means operatively connected to said one or more torsion bars for adjusting said one or more torsion bars.

6. A gate operator for use in combination with a gate for raising and lowering said gate about a horizontal axis, said gate operator comprising:

a gate structure having a horizontal pivot means pivotally connected to a proximal end of said gate for rotation of said gate between a horizontal closed position and a vertical open position;

a motor connected to a first pulley, said first pulley operatively connected to a second pulley;

a cam disposed in a raceway, said cam and said raceway connecting said second pulley to said gate to move said gate between said horizontal closed position and said vertical open position upon rotational movement of said second pulley;

one or more torsion bars;

adjustment means operatively connected to said one or more torsion bars for adjusting said one or more torsion bars; and gear means for operatively connecting said second pulley to said one or more torsion bars, said gear means configured to store energy to said one or more torsion bars during the movement of said gate from said vertical open position to said horizontal closed position.

7. A gate operator for use in combination with a gate for raising and lowering said gate about a horizontal axis, said gate operator comprising:

a gate structure having a pivot member pivotally connected to a proximal end of said gate for rotation of said gate between a horizontal closed position and a vertical open position;

a motor;

drive means connecting said motor to said gate for moving said gate between said horizontal closed position and said vertical open position;

energy accumulator means for storing energy during the movement of said gate from said vertical open position to said horizontal closed position and releasing said energy during the movement of said gate from said horizontal closed position to said vertical open position; and lever means for operatively connecting said pivot member to said energy accumulator means, said lever means configured to store energy to said energy accumulator means during the movement of said gate from said vertical open position to said horizontal closed position.

8. The gate operator according to claim 7, wherein said drive means comprises a first pulley operatively connected to a second pulley.

9. The gate operator according to claim 7, wherein said drive means comprises a roller cam disposed in a raceway.

10. The gate operator according to claim 9, wherein said drive means further comprises a first pulley operatively connected to a second pulley, said roller cam and said raceway connecting said second pulley to said gate to move said gate between said horizontal closed position and said vertical open position upon rotational movement of said second pulley.

11. The gate operator according to claim 7 further comprising adjustment means operatively connected to said energy accumulator means for adjusting the amount of energy stored in said energy accumulator means during the movement of said gate from said vertical open position to said horizontal closed position.

12. The gate operator according to claim 7, wherein said lever means comprises a lever having a first end and a second end, said first end of said lever connected to said pivot member, said second end of said lever connected to said energy accumulator means.

13. The gate operator according to claim 7, wherein said energy accumulator means comprises a cylinder having a proximal end and a distal end, said cylinder pivotally connected to said gate structure, a piston slidably disposed in said cylinder and a shaft interconnecting said piston and said lever means.

14. The gate operator according to claim 13 further comprising one or more bladders in said cylinder for storing a gas therein.

15. The gate operator according to claim 14, wherein at least one of said one or more bladders is disposed in said cylinder between said piston and said proximal end of said cylinder for storing energy during the rotation of said gate from said vertical open position to said horizontal closed position.

16. The gate operator according to claim 14 further comprising an adjustment bladder in at least one of said one or more bladders and an inlet means connected to said adjustment bladder for adding or removing gas from said adjustment bladder.

17. The gate operator according to claim 16 further comprising pressure regulating means connected to said adjustment bladder for regulating the pressure of said adjustment bladder.

18. The gate operator according to claim 13 further comprising two or more rods disposed between said piston and said shaft.

19. The gate operator according to claim 13 further comprising one or more springs in said cylinder.

20. The gate operator according to claim 19, wherein at least one of said one or more springs is disposed in said cylinder between said piston and said proximal end of said cylinder for storing energy during the rotation of said gate from said vertical open position to said horizontal closed position.

21. A gate operator for use in combination with a gate for raising and lowering said gate about a horizontal axis, said gate operator comprising:

a gate structure having a pivot member pivotally connected to a proximal end of said gate for rotation of said gate between a horizontal closed position and a vertical open position;

a motor connected to a first pulley, said first pulley operatively connected to a second pulley;

a cam disposed in a raceway, said cam and said raceway connecting said second pulley to said gate to move said gate between said horizontal closed position and said vertical open position upon rotational movement of said second pulley;

drive means connecting said motor to said gate for moving said gate between said horizontal closed position and said vertical open position;

a lever connected at one end to said pivot member;

a cylinder having a distal end and a proximal end, said cylinder pivotally connected to said gate structure;

a piston slidably disposed in said cylinder; and a shaft interconnecting said piston and said lever.

22. The gate operator according to claim 21 further comprising one or more bladders in said cylinder for storing compressed energy therein.

23. The gate operator according to claim 22, wherein at least one of said one or more bladders is disposed in said cylinder between said piston and said proximal end of said cylinder for storing energy during the rotation of said gate from said vertical open position to said horizontal closed position.

24. The gate operator according to claim 22 further comprising an adjustment bladder in at least one of said one or more bladders and an inlet means connected to said adjustment bladder for adding or removing gas from said adjustment bladder.

25. The gate operator according to claim 24 further comprising pressure regulating means connected to said adjustment bladder for regulating the pressure of said adjustment bladder.

26. The gate operator according to claim 21 further comprising two or more rods disposed between said piston and said shaft.

27. The gate operator according to claim 21 further comprising one or more springs in said cylinder.

28. The gate operator according to claim 27, wherein at least one of said one or more springs is disposed in said cylinder between said piston and said proximal end of said cylinder for storing energy during the rotation of said gate from said vertical open position to said horizontal closed position.

* * * * *